United States Patent [19]

Livingstone

[11] 3,936,009

[45] Feb. 3, 1976

[54] COLLAPSIBLE DYE TUBE

[76] Inventor: Stanley Livingstone, Wilkinson Blvd., P.O. Box 8282, Charlotte, N.C. 28208

[22] Filed: Aug. 26, 1974

[21] Appl. No.: 500,474

[52] U.S. Cl. ..... 242/118.11

[51] Int. Cl.² ..... B65H 75/20

[58] Field of Search..... 242/118.1, 118.11, 118.2; 68/198

[56] References Cited

UNITED STATES PATENTS

| | | | |
|---|---|---|---|
| 3,465,984 | 9/1969 | Tigges et al. | 242/118.11 |
| 3,718,287 | 2/1973 | Sottosanti | 242/118.11 |
| 3,753,534 | 8/1973 | Ono et al. | 242/118.11 |

*Primary Examiner*—Leonard D. Christian

[57] ABSTRACT

Dye tube, for use with yarn wound therearound in stacked, end-to-end relationship with other such tubes on a perforated dyeing spindle, comprising a multiplicity of yarn-supporting rings spaced along an axis and a multiplicity of connectors spaced circumferentially about the tube and extending between adjacent rings, each said connector having its opposite ends respectively joined to adjacent rings and having a preferentially radially inwardly movable buckling portion between its ends, whereby, upon the application of axial force to the tube, its adjacent rings will approach each other while its connectors buckle toward the axis.

8 Claims, 2 Drawing Figures

COLLAPSIBLE DYE TUBE

BACKGROUND OF THE INVENTION

This invention relates to dye tubes of the general sort disclosed in U.S. Pat. No. 3,448,597 for carrying yarn wound therearound in a dyeing process in which the tubes are stacked end-to-end on a perforated spindle.

It has been found desirable to make such tubes compressible along their longitudinal axis, increasing the number of tubes which can be stacked on a given spindle. Examples of axially compressible tubes appear in U.S. Pat. Nos. 3,465,984; 3,561,696; 3,561,697; 3,563,491; 3,753,534; 3,756,531; 3,756,532; and 3,759,461.

SUMMARY OF THE INVENTION

The invention provides a dye tube which can be axially compressed without yarn waste due to pinching or snagging, particularly during winding off; which can accomodate itself to yarn shrinkage; which provides for uniform flow of dye fluid; which is easily handled and is self-centering on the dye spindle; and which is simple and inexpensive to manufacture.

In general, the invention features a dye tube, for use with yarn wound therearound in stacked, end-to-end relationship with other such tubes on a perforated dyeing spindle, comprising a multiplicity of yarn-supporting rings spaced along an axis and a multiplicity of connectors spaced circumferentially about the tube and extending between adjacent rings, each said connector having its opposite ends respectively joined to adjacent rings and having a preferentially radially inwardly movable buckling portion between its ends, whereby, upon the application of axial force to the tube, its adjacent rings will approach each other while its connectors buckle toward the axis. In preferred embodiments the connectors are strips with concavely curved outer surfaces and are generally parallel to the axis; the relationship of the length of the connectors and the inside diameter of the tube to the outside diameter of the spindle in such that, when the axial force is applied the connectors will contact the spindle, centering the tube thereon and limiting the buckling of the connectors to prevent pinching of the yarn; the length of the tube when the connectors touch the spindle is between 50% and 75% of the original length of the tube; and the spindle has an outside diameter of 1.315 inches or 1.900 inches.

Other advantages and features of the invention will be apparent from the description and drawings herein of a preferred embodiment thereof.

DESCRIPTION OF THE PREFERRED EMBODIMENT

Figure 2:
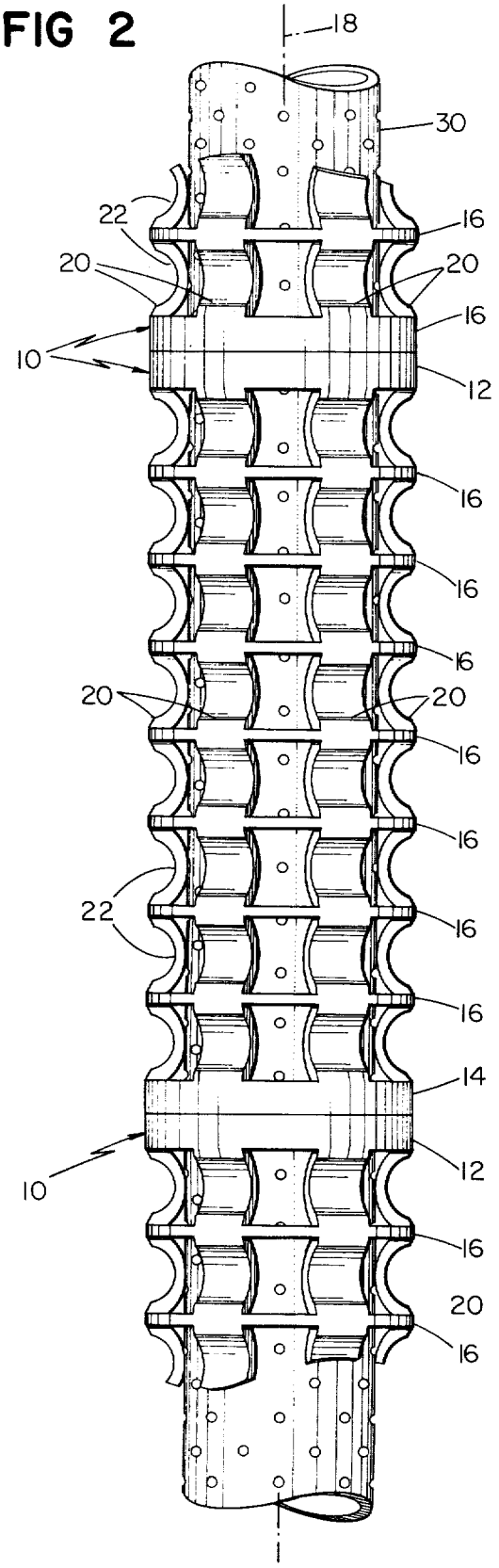
FIG. 2 is a side view similar to FIG. 1 but showing one tube and fragments of two others axially compressed.
Figure 1:
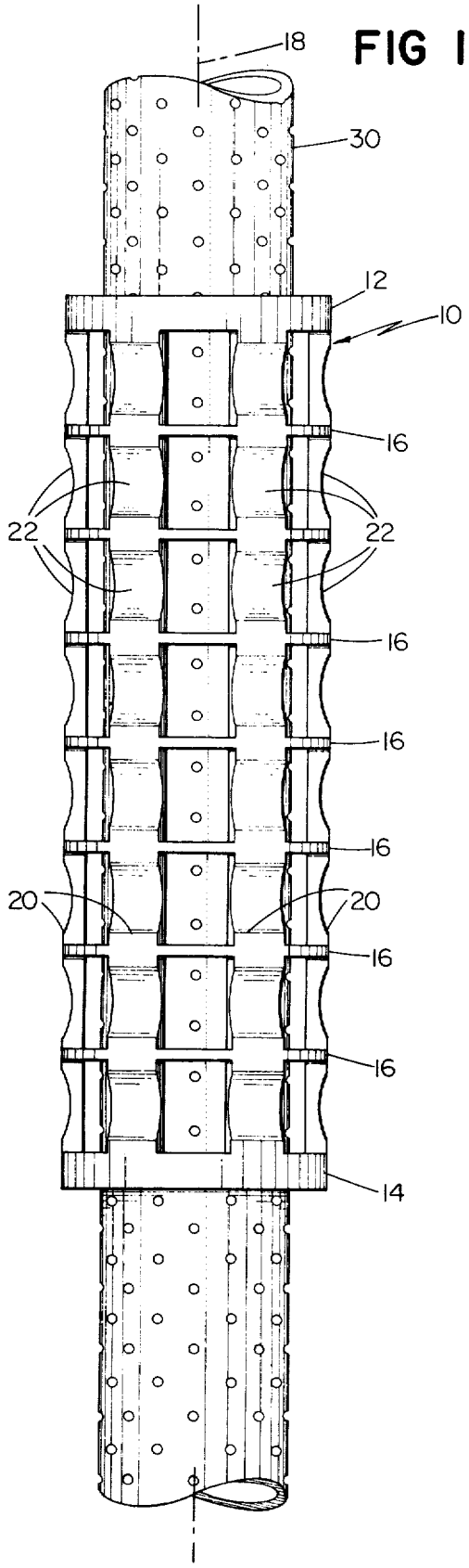
FIG. 1 is a side view of a dye tube embodying the invention, positioned on a spindle.

Referring to the drawings, one piece, molded plastic dye tube 10 has coaxial end rings 12, 14 and seven intermediate rings 16 spaced along axis 18. Adjacent rings are connected to each other by six semi-flexible connector strips 20, each of which is designed to preferentially buckle inwardly upon axial compression by virtue of a concave or indented outer surface 22.

The tube is designed for use with others like it on a standard 1.315 inches or 1.900 inches O. D. perforated dye spindle 30, and in the embodiment shown has the following dimensions:

| | | |
|---|---|---|
| length | 6.75" | |
| I.D. of rings 12, 14, and 16 | 1.625" | (or 2.5" for the O.D. spindle) |
| | 1.900" | |
| width (along axis 18) of rings 16 | 1/16" | |
| width (along axis 18) of rings 12 and 14 | 3/16" | |
| thickness (perpendicular to axis 18) of rings 12, 14, and 16 | 1/8" | |
| thickness (perpendicular to axis 18) of strips 20 | 1/8" | at ends, |
| | 1/16" | at center |
| width (circumferentially of axis 18) of strips 20 | 3/8" | |

In use, yarn (not shown) is wound on the tubes, which are then stacked end-to-end on spindle 30 and compressed along axis 18. As the tubes are compressed strips 20 buckle inwardly, due to the indentations in surfaces 22, and eventually contact the spindle, which acts as a stop to prevent further compression of the tube. The relationship of the diameters of tube and spindle and the length of strips 20 is such that the fully (i.e., to the extent permitted by the spindle) compressed tube is 50–75% (preferably about 60%) as long as when uncompressed, so that the yarn is not pinched by strips 20. The inward movement of strips 20 also avoids protrusion of any part of the dye tube beyond the original cylindrical envelope of the tube, so that yarn is not snagged and can be wound off smoothly. The contour of the tube provides for very uniform dye flow. Strips 20 also serve to center the compressed tubes on the spindle, ensuring alignment of end rings 12 and 14 of adjacent tubes, and hence tube-to-tube sealing (such sealing being explained in U.S. Pat. No. 3,448,597, the disclosure of which is hereby incorporated by reference).

Other embodiments are within the following claims. What is claimed is:

1. In a system consisting of a perforated dyeing spindle and a plurality of dye tubes useful with yarn wound therearound, in stacked, end-to-end relationship on said spindle, that improvement consisting of an improved dye tube comprising, a multiplicity of continuous yarn-supporting rings spaced along an axis, and a multiplicity of connectors spaced circumferentially about said tube and extending between adjacent said rings, each said connector having its opposite ends respectively joined to said adjacent rings and having an inherently preferentially radially inwardly movable buckling portion between said ends, whereby upon the application of axial force to said tube said adjacent rings will approach each other while said connectors buckle toward said axis.

2. The tube of claim 1 wherein the said connectors are strips which, when said tube is axially fully extended, have outer surfaces with indentations extending circumferentially of said tube and across the full width of the connectors to create said buckling portions.

3. The tube of claim 2 wherein said indentations are concavely curved portions of said outer surfaces.

4. The tube of claim 1 wherein the relationship of the length of said connectors and the inside diameter of said tube to to the outside diameter of said spindle is such that, when said axial force is applied said connectors will contact said spindle, centering said tube thereon and limiting the buckling of said connectors to prevent pinching of said yarn.

5. The tube of claim 4 wherein the length of said tube when said connectors touch said spindle is between 50 and 75% of the original length of said tube.

6. The tube of claim 4 wherein said spindle has an outside diameter of 1.315 inches.

7. The tube of claim 4 wherein said spindle has an outside diameter of 1.900 inches.

8. The tube of claim 1 wherein said connectors are generally parallel to said axis.

* * * * *